US010801762B2

(12) United States Patent
Brostrom et al.

(10) Patent No.: US 10,801,762 B2
(45) Date of Patent: Oct. 13, 2020

(54) COMPRESSOR FLOODBACK PROTECTION SYSTEM

(71) Applicant: EMERSON CLIMATE TECHNOLOGIES, INC., Sidney, OH (US)

(72) Inventors: Troy Richard Brostrom, Lima, OH (US); Reema Kamat, Sidney, OH (US); Eric Winandy, Esneux (BE); Stephane Bertagnolio, Liege (BE)

(73) Assignee: Emerson Climate Technologies, Inc., Sidney, OH (US)

( * ) Notice: Subject to any disclaimer, the term of this patent is extended or adjusted under 35 U.S.C. 154(b) by 349 days.

(21) Appl. No.: 15/428,410

(22) Filed: Feb. 9, 2017

(65) Prior Publication Data

US 2017/0241689 A1 Aug. 24, 2017

Related U.S. Application Data

(60) Provisional application No. 62/296,841, filed on Feb. 18, 2016.

(51) Int. Cl.
*F25B 49/02* (2006.01)
*F25B 49/00* (2006.01)

(52) U.S. Cl.
CPC ..... *F25B 49/005* (2013.01); *F25B 49/022* (2013.01); *F25B 2600/02* (2013.01);
(Continued)

(58) Field of Classification Search
CPC ..... F25B 2700/21155; F25B 2700/151; F25B 49/022; F25B 2600/02; F25B 2700/2105; F25B 49/005
See application file for complete search history.

(56) References Cited

U.S. PATENT DOCUMENTS 6,018,959 A 2/2000 Schmidt
7,079,967 B2 7/2006 Rossi et al.
(Continued)

FOREIGN PATENT DOCUMENTS

CN 101506600 A 8/2009
CN 204154404 U 2/2015
(Continued)

OTHER PUBLICATIONS

International Search Report regarding International Application No. PCT/US2017/018484, dated Jun. 1, 2017.
(Continued)

*Primary Examiner* — David J Teitelbaum
(74) *Attorney, Agent, or Firm* — Harness, Dickey & Pierce, P.L.C.

(57) ABSTRACT

A climate-control system may include a compressor, a condenser, an evaporator, a first sensor, a second sensor, a third sensor, and a control module. The compressor may include a motor and a compression mechanism. The condenser receives compressed working fluid from the compressor. The evaporator is in fluid communication with the compressor and disposed downstream of the condenser and upstream of the compressor. The first sensor may detect an electrical operating parameter of the motor. The second sensor may detect a discharge temperature of working fluid discharged by the compression mechanism. The third sensor may detect a suction temperature of working fluid between the evaporator and the compression mechanism. The control module is in communication with the first, second and third sensors and may determine whether a refrigerant floodback condition is occurring in the compressor based on data received from the first, second and third sensors.

12 Claims, 8 Drawing Sheets

(52) U.S. Cl.
CPC . *F25B 2700/151* (2013.01); *F25B 2700/2105* (2013.01); *F25B 2700/21155* (2013.01)

(56) References Cited

U.S. PATENT DOCUMENTS

| | | | | |
|---|---|---|---|---|
| 7,114,343 | B2 | 10/2006 | Kates | |
| 7,201,006 | B2 | 4/2007 | Kates | |
| 7,234,313 | B2 | 6/2007 | Bell et al. | |
| 7,412,842 | B2 | 8/2008 | Pham | |
| 7,469,546 | B2 | 12/2008 | Kates | |
| 7,484,376 | B2 | 2/2009 | Pham | |
| 7,775,057 | B2 | 8/2010 | VanderZee | |
| 8,418,483 | B2 | 4/2013 | McSweeney et al. | |
| 8,459,051 | B2 | 6/2013 | Jeong et al. | |
| 8,572,995 | B2 | 11/2013 | Kasahara | |
| 8,590,328 | B2 | 11/2013 | Bittner et al. | |
| 8,924,181 | B2 | 12/2014 | Hrncar et al. | |
| 2003/0077179 | A1* | 4/2003 | Collins | F04B 49/065 417/63 |
| 2005/0235660 | A1* | 10/2005 | Pham | F04C 28/00 62/126 |
| 2006/0259276 | A1 | 11/2006 | Rossi et al. | |
| 2007/0089436 | A1 | 4/2007 | Singh et al. | |
| 2007/0205296 | A1 | 9/2007 | Bell et al. | |
| 2008/0209925 | A1 | 9/2008 | Pham | |
| 2009/0090118 | A1 | 4/2009 | Pham et al. | |
| 2009/0094997 | A1 | 4/2009 | McSweeney | |
| 2009/0095002 | A1* | 4/2009 | McSweeney | F25B 49/022 62/216 |
| 2010/0204840 | A1 | 8/2010 | Sun et al. | |
| 2011/0185753 | A1 | 8/2011 | Lifson et al. | |
| 2011/0209485 | A1 | 9/2011 | Lifson et al. | |
| 2012/0247138 | A1 | 10/2012 | Senf, Jr. et al. | |
| 2012/0260678 | A1 | 10/2012 | Yoshida | |
| 2012/0272673 | A1 | 11/2012 | Yokohara et al. | |
| 2013/0167567 | A1 | 7/2013 | Fukui et al. | |
| 2014/0137573 | A1 | 5/2014 | Lin et al. | |
| 2014/0138451 | A1* | 5/2014 | Pham | F04B 35/04 237/12 |
| 2014/0163744 | A1 | 6/2014 | Dolcich et al. | |
| 2015/0027139 | A1 | 1/2015 | Lin et al. | |
| 2015/0033780 | A1 | 2/2015 | Hatomura et al. | |
| 2015/0068231 | A1 | 3/2015 | Rite et al. | |
| 2016/0018148 | A1* | 1/2016 | Yura | F25B 13/00 62/192 |

FOREIGN PATENT DOCUMENTS

| | | | |
|---|---|---|---|
| EP | 2952829 | A1 | 12/2015 |
| JP | H07180933 | A | 7/1995 |
| WO | WO-2009038624 | A1 | 3/2009 |

OTHER PUBLICATIONS

Written Opinion of the International Searching Authority regarding International Application No. PCT/US2017/018484, dated Jun. 1, 2017.

International Preliminary Report on Patentability regarding International Application No. PCT/US2017/018484 dated Aug. 30, 2018.

Search Report regarding European Patent Application No. 17753978.0, dated Oct. 4, 2019.

Office Action regarding Chinese Patent Application No. 201780017945.6, dated Feb. 26, 2020 . Translation provided by Unitalen Attorneys at Law.

* cited by examiner

| Dilution Coefficients | |
|---|---|
| a1 | 3.27 |
| a2 | -170 |
| a3 | -119000 |
| a4 | -0.52 |
| a5 | 574 |
| a6 | -97600 |
| a7 | -0.414 |
| a8 | 101 |
| a9 | -15400 |

FIG 6

COMPRESSOR FLOODBACK PROTECTION SYSTEM

CROSS-REFERENCE TO RELATED APPLICATIONS

This application claims the benefit of U.S. Provisional Application No. 62/296,841, filed on Feb. 18, 2016. The entire disclosure of the above application is incorporated herein by reference.

FIELD

The present disclosure relates to a compressor floodback protection system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a climate-control system that may include a compressor, a condenser, an evaporator, a first sensor, a second sensor, a third sensor, and a control module. The compressor may include a motor and a compression mechanism. The condenser receives compressed working fluid from the compressor. The evaporator is in fluid communication with the compressor and disposed downstream of the condenser and upstream of the compressor. The first sensor may detect an electrical operating parameter of the motor. The second sensor may detect a discharge temperature of working fluid discharged by the compression mechanism. The third sensor may detect a suction temperature of working fluid between the evaporator and the compression mechanism. The control module is in communication with the first, second and third sensors and may determine whether a refrigerant floodback condition is occurring in the compressor based on data received from the first, second and third sensors.

In some configurations, the control module determines whether the refrigerant floodback condition is occurring based on a comparison between a calculated discharge-superheat-value and a predetermined discharge-superheat-threshold.

In some configurations, the only measured data used to detect the refrigerant floodback condition is data measured by the first, second and third sensors.

In some configurations, a severity of the refrigerant floodback condition is determined based on a level of oil dilution in an oil sump of the compressor.

In some configurations, the control module issues a fault warning or a fault trip in response to determining the severity of the refrigerant floodback condition.

In some configurations, the level of oil dilution is calculated using the equation:

$$\log_{10}(P) = a_1 + \frac{a_2}{T} + \frac{a_3}{T^2} + \log_{10}(\omega)\left(a_4 + \frac{a_5}{T} + \frac{a_6}{T^2}\right) + \log_{10}^2(\omega)\left(a_7 + \frac{a_8}{T} + \frac{a_9}{T^2}\right),$$

wherein P is a pressure of gas immediately above an oil level in the oil sump within the compressor; wherein $\omega$ is the level of oil dilution; wherein T is a temperature of the oil in the oil sump; and wherein $a_1$ through $a_9$ are constants.

In some configurations, the severity of the refrigerant floodback condition is determined based on a comparison of the level of oil dilution and a dilution limit value.

In some configurations, the dilution limit value is determined based on a calculated condensing temperature and a calculated evaporating temperature.

In some configurations, the pressure (P) of gas immediately above the oil level is measured by the third sensor.

In some configurations, the compressor is a low-side scroll compressor.

In another form, the present disclosure provides a system that may include a compressor, a first heat exchanger, a second heat exchanger, a first sensor, a second sensor, a third sensor, a fourth sensor, and processing circuitry. The compressor includes a shell, a compression mechanism disposed within the shell, and a motor driving the compression mechanism. The first heat exchanger may receive compressed working fluid from the compressor. The second heat exchanger is in fluid communication with the compressor and the first heat exchanger and may provide suction-pressure working fluid to the compressor. The first sensor may detect a parameter (e.g., electrical current of the motor or pressure of working fluid at a location along a high-pressure side of the system) indicative of a temperature of working fluid within the first heat exchanger (e.g., a saturated temperature or a condensing temperature). The second sensor may detect a discharge temperature of fluid discharged from the compressor. The third sensor may detect a suction temperature of fluid upstream of the compression mechanism and downstream of the first and second heat exchangers. The fourth sensor may detect an oil temperature of oil in a sump defined by the shell. The processing circuitry is in communication with the first, second, third and fourth sensors. The processing circuitry may determine whether a refrigerant floodback condition is occurring in the compression mechanism and a severity of the refrigerant floodback condition based on data received from the first, second, third and fourth sensors.

In some configurations, the first sensor is a current sensor that measures a current of the motor.

In some configurations, the first sensor is a pressure sensor that measures a pressure of working fluid at a location along a high-pressure side of the system.

In some configurations, the only measured data used to detect the refrigerant floodback condition is data measured by the first, second and third sensors.

In some configurations, the processing circuitry determines whether a refrigerant floodback condition has occurred based on a comparison between a calculated discharge-superheat-value and a predetermined discharge-superheat-threshold.

In some configurations, the severity of the refrigerant floodback condition is determined based on a level of oil dilution in an oil sump disposed within the shell of the compressor.

In some configurations, the level of oil dilution is calculated using the equation:

$$\log_{10}(P) = a_1 + \frac{a_2}{T} + \frac{a_3}{T^2} + \log_{10}(\omega)\left(a_4 + \frac{a_5}{T} + \frac{a_6}{T^2}\right) + \log_{10}^2(\omega)\left(a_7 + \frac{a_8}{T} + \frac{a_9}{T^2}\right),$$

wherein P is a pressure of gas immediately above an oil level in the oil sump within the compressor; wherein ω is the level of oil dilution; wherein T is a temperature of the oil in the oil sump; and wherein $a_1$ through $a_9$ are constants.

In some configurations, the severity of the refrigerant floodback condition is determined based on a comparison of the level of oil dilution and a dilution limit value.

In some configurations, the dilution limit value is determined based on a calculated condensing temperature and a calculated evaporating temperature.

In some configurations, the pressure (P) of gas immediately above the oil level is determined based on the suction temperature measured by the third sensor.

In some configurations, the processing circuitry issues a fault warning or a fault trip in response to determining the severity of the refrigerant floodback condition.

In some configurations, the compressor is a low-side scroll compressor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6 is a table of exemplary dilution coefficient values;

Corresponding reference numerals indicate corresponding parts throughout the several views of the drawings.

DETAILED DESCRIPTION

Figure 1:
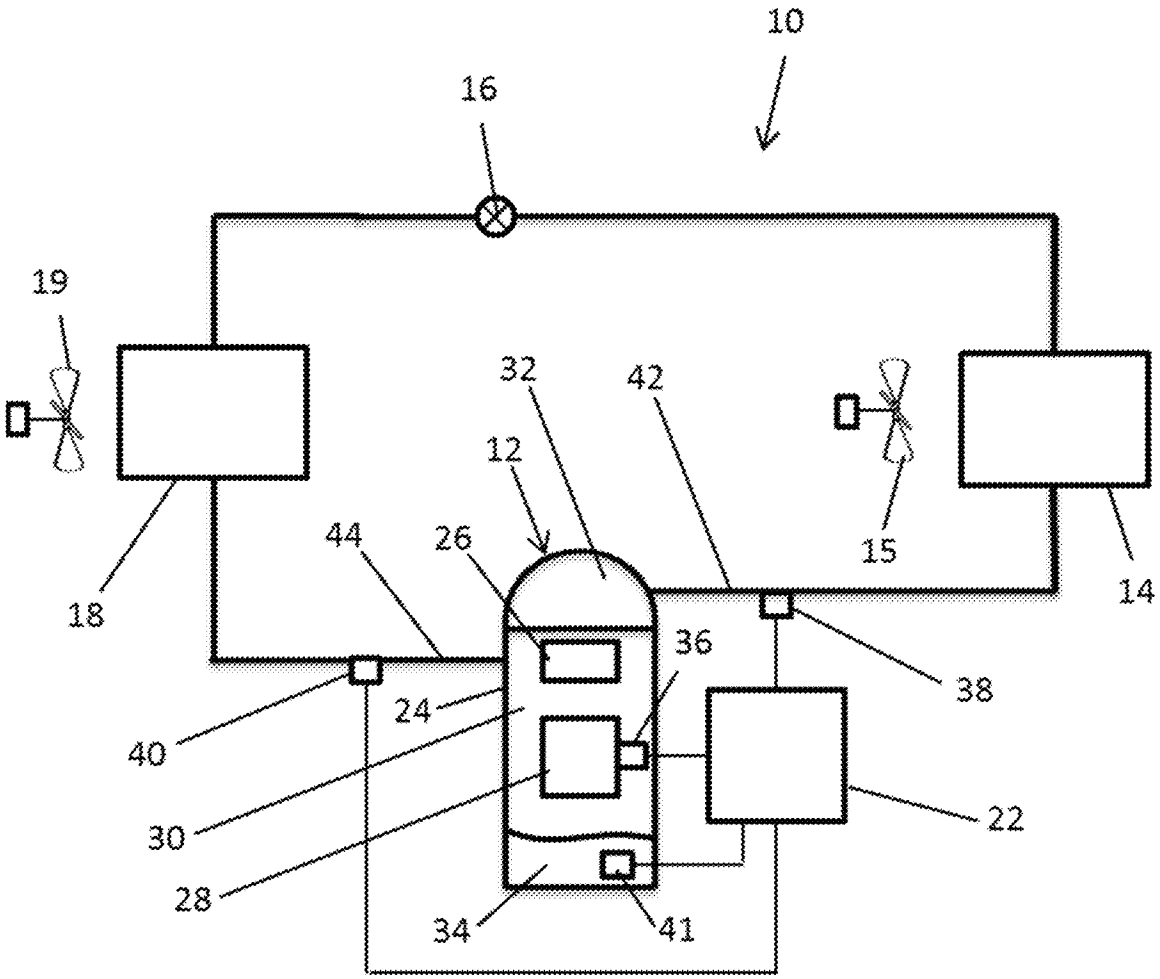
FIG. 1 is a schematic representation of an exemplary climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include one or more compressors 12, an outdoor heat exchanger 14, an outdoor blower 15, an expansion device 16 (e.g., an expansion valve, capillary tube, etc.), an indoor heat exchanger 18, and an indoor blower 19. The compressor 12 compresses working fluid (e.g., refrigerant, carbon dioxide, etc.) and circulates the working fluid throughout the system 10. In some configurations, the climate-control system 10 may be a heat-pump system having a reversing valve (not shown) operable to control a direction of working fluid flow through the system 10 to switch the system 10 between a heating mode and a cooling mode. In some configurations, the climate-control system 10 may be a chiller system, an air-conditioning system or a refrigeration system, for example, and may be operable in only the cooling mode. As will be described in more detail below, a control module 22 may include processing circuitry that determines whether a floodback condition is occurring in the compressor 12 and a severity level of the floodback condition. In some configurations, the control module 22 may also control operation of one or more of the compressor 12, the outdoor blower 15, the expansion device 16 and the indoor blower 19.

The compressor 12 may include a shell 24, a compression mechanism 26 and a motor 28. The compression mechanism 26 is disposed within the shell 24 and is driven by the motor 28 via a crankshaft (not shown). In the particular configuration shown in FIG. 1, the compressor 12 is a low-side scroll compressor. That is, the compression mechanism 26 is a scroll compression mechanism disposed within a suction-pressure region 30 of the shell 24. The compression mechanism 26 draws suction-pressure working fluid from the suction-pressure region 30 and may discharge compressed working fluid into a discharge-pressure region 32 of the shell 24. The motor 28 may also be disposed within the suction-pressure region 30. A lower end of the suction-pressure region 30 of the shell 24 may define an oil sump 34 containing a volume of oil for lubrication and cooling of the compression mechanism 26, the motor 28 and other moving parts of the compressor 12.

While the compressor 12 is described above as a low-side compressor, in some configurations, the compressor 12 could be a high-side compressor (i.e., the compression mechanism 26, motor 28 and oil sump 34 could be disposed in a discharge-pressure region of the shell). Furthermore, in some configurations, the compressor 12 could be a reciprocating compressor or a rotary vane compressor, for example, rather than a scroll compressor.

In a cooling mode, the outdoor heat exchanger 14 may operate as a condenser or as a gas cooler and may cool discharge-pressure working fluid received from the compressor 12 by transferring heat from the working fluid to air forced over the outdoor heat exchanger 14 by the outdoor blower 15, for example. The outdoor blower 15 could include a fixed-speed, multi-speed or variable-speed fan. In the cooling mode, the indoor heat exchanger 18 may operate as an evaporator in which the working fluid absorbs heat from air forced over the indoor heat exchanger 18 by the indoor blower 19. In a heating mode (in configurations where the system 10 is a heat pump), the outdoor heat exchanger 14 may operate as an evaporator, and the indoor heat exchanger 18 may operate as a condenser or as a gas cooler and may transfer heat from working fluid discharged from the compressor 12 to air forced over the indoor heat exchanger 18 by the indoor blower 19.

The control module 22 may be in communication with first, second, third and fourth sensors 36, 38, 40, 41. The first sensor 36 may be a current sensor disposed within the shell 24 that measures a current draw of the motor 28. The second sensor 38 may be a temperature sensor and may measure a discharge temperature of working fluid discharged from the compressor 12. In some configurations, the second sensor 38 may be mounted on a discharge line 42 that fluidly connects the compressor 12 and the outdoor heat exchanger 14. In some configurations, the second sensor 38 could be mounted within the compressor 12 (e.g., in the discharge-pressure region 32 or at the discharge passage of the compression mechanism 26). The third sensor 40 may be a temperature sensor and may measure a suction temperature of working fluid provided to the compressor 12. In some configurations, the third sensor 40 may be mounted on a suction line 44 that fluidly connects the compressor 12 and the indoor heat exchanger 18. In some configurations, the third sensor 40 may be mounted within the compressor 12 (e.g., in the suction-pressure region 30) or on a suction fitting connecting the suction line 44 with the shell of the compressor 12. The fourth sensor 41 may be a temperature sensor disposed within the oil sump 34 and may measure a temperature of oil in the oil sump 34. The sensors 36, 38, 40, 41 may take measurements and communicate those measurements to the control module 22 intermittently, continuously, or on-demand. Communication between the sensors 36, 38, 40, 41 and the control module 22 may be wired or wireless.

As described above, the control module 22 determines whether a floodback condition is occurring in the compressor 12 and a severity level of the floodback condition. The control module 22 may determine whether the floodback condition is occurring using measured data only from the first, second and third sensors 36, 38, 40.

A floodback condition is a condition where liquid working fluid flows into the suction line 44 from the evaporator 18. During a floodback condition, the working fluid in the suction line 44 may not be completely evaporated and may be at least partially in liquid phase (i.e., a mixture of gaseous and liquid working fluid or entirely liquid working fluid). Severe liquid floodback can be detrimental to the reliability of the compressor 12 and can unacceptably increase oil dilution and reduce oil viscosity and oil-film thicknesses between mating moving parts, which can damage the moving parts. Floodback conditions can be caused by blocked evaporator fans, stuck or malfunctioning expansion valves, and defrost cycles, for example.

While severe floodback can be detrimental to compressor health, lower levels of floodback can be beneficial. For example, acceptable levels of floodback can lower discharge temperatures and increase oil-film thicknesses during certain operating conditions of the system 10 (e.g., operating conditions where evaporating temperatures are low and condensing temperatures are high). Beneficial levels of floodback can expand the operating envelope of the compressor and reduce or eliminate the need for liquid-injection or vapor-injection systems in certain applications.

Figure 2:
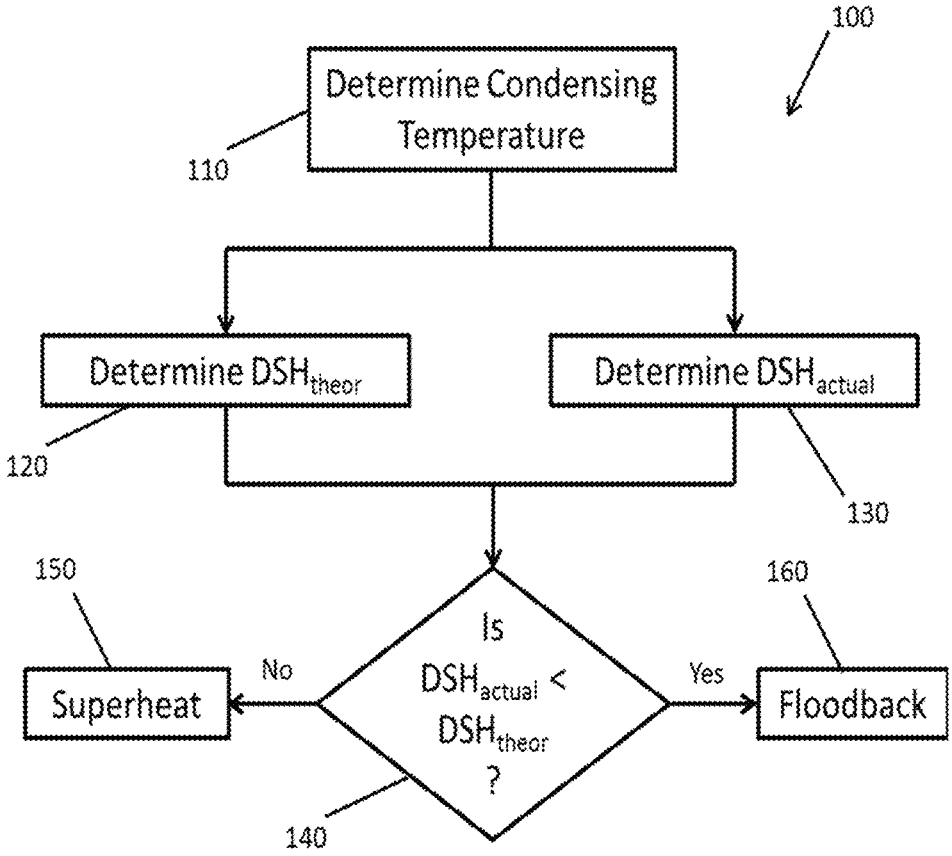
FIG. 2 is a flowchart depicting an algorithm for detecting a floodback condition.
Figure 3:
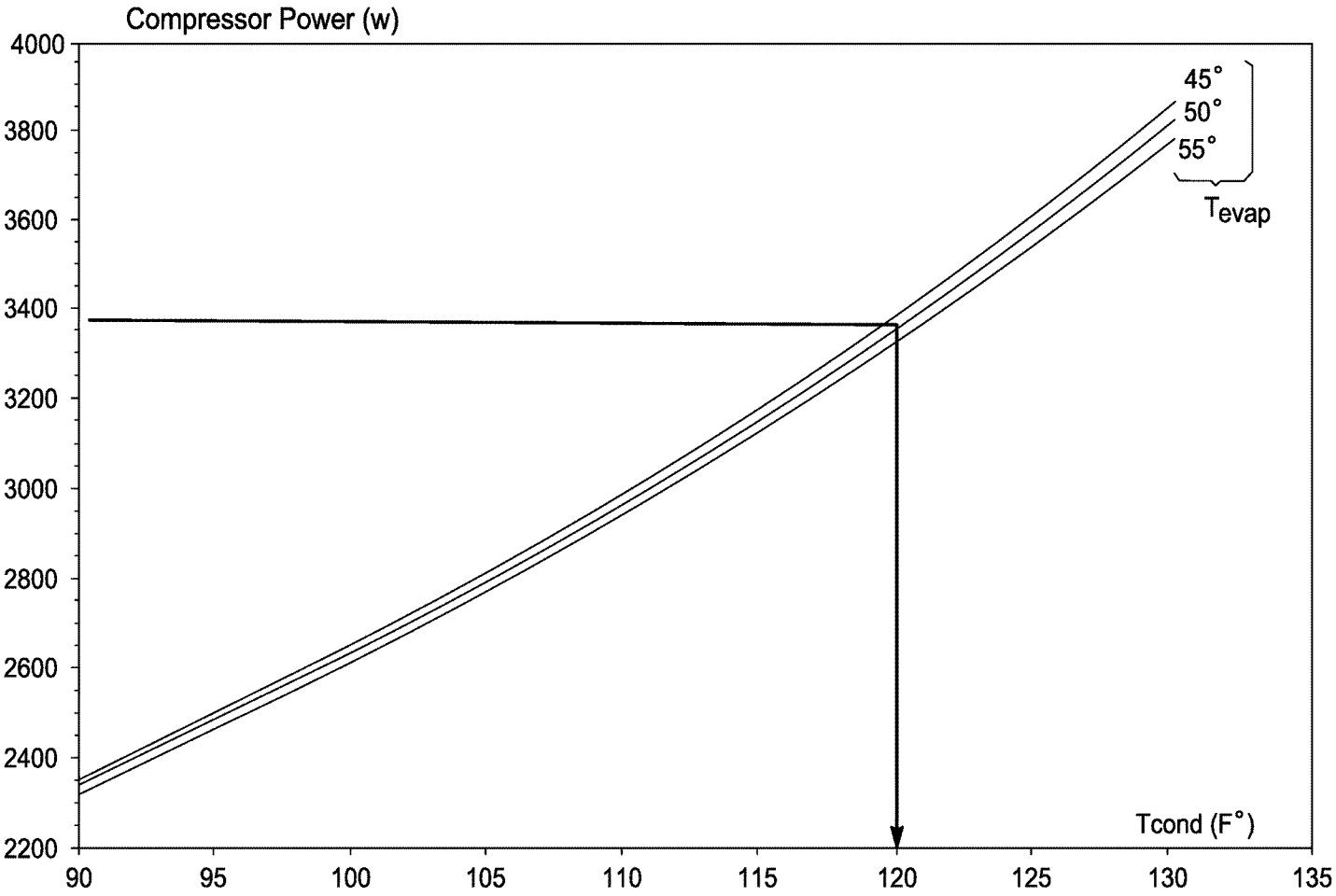
FIG. 3 is a graph illustrating a relationship among compressor power, evaporating temperature and condensing temperature.

With reference to FIG. 2, a floodback-detection algorithm 100 will be described. At step 110, the control module 22 determines a non-measured condensing temperature value of the system 10. The control module 22 can determine the condensing temperature based on data received from only the first sensor 36. FIG. 3 includes a graph showing compressor power as a function of evaporating temperature ($T_{evap}$) and condensing temperature ($T_{cond}$). As shown, power remains fairly constant irrespective of evaporating temperature. Therefore, while an exact evaporating temperature can be determined by a second degree polynomial (i.e., a quadratic function), for purposes of detecting floodback, the evaporating temperature can be determined by a first degree polynomial (i.e., linear function) and can be approximated as roughly 45 degrees F., for example, in a cooling mode. In other words, the error associated with choosing an incorrect evaporating temperature is minimal when determining condensing temperature.

The graph of FIG. 3 includes compressor power on the Y-axis and condensing temperature on the X-axis. Compressor power P can be determined using the equation P=V*I, where I is the measured compressor current obtained by the first sensor 36 and V is a known voltage for a given compressor. Compressor power P can also be determined using the equation $P=I^2R$, wherein R is a known resistance of the motor 28.

The condensing temperature is calculated for the individual compressor and is therefore specific to compressor model and size. The following equation is used in determining condensing temperature, where P is compressor power, C0-C9 are compressor-specific constants, $T_{cond}$ is condensing temperature, and $T_{evap}$ is evaporating temperature:

$$P=C0+(C1*T_{cond})+(C2*T_{evap})+(C3*T_{cond}\hat{}2)+(C4*T_{cond}*T_{evap})+(C5*T_{evap}\hat{}2)+(C6*T_{cond}\hat{}3)+(C7*T_{evap}*T_{cond}\hat{}2)+(C8*T_{cond}*T_{evap}\hat{}2)+(C9*T_{evap}\hat{}3)$$

The above equation is applicable to all compressors, with constants C0-C9 being compressor model and size specific, as published by compressor manufacturers, and can be simplified as necessary by reducing the equation to a second-order polynomial with minimal compromise on accuracy. The equations and constants can be loaded into the control module 22 by the manufacturer, in the field during installation using a hand-held service tool, or downloaded directly to the control module 22 from the internet, for example.

The condensing temperature, at a specific compressor power (based on measured current draw by the first sensor 36), is determined by referencing a plot of evaporating temperature (using the equation above, for example) for a given system versus compressor power consumption. The condensing temperature can be read by cross-referencing power consumption (determined from a measured current reading) against the evaporating temperature plot. Therefore, the condensing temperature is simply a function of reading a current drawn at the first sensor 36. For example, FIG. 3 shows an exemplary power consumption of 3400 watts (as determined by the current draw read by the first sensor 36). The control module 22 is able to determine the condensing temperature by simply cross-referencing power consumption of 3400 watts for a given evaporating temperature (i.e., 45 degrees F., 50 degrees F., 55 degrees F., as shown) to determine the corresponding condensing temperature. It should be noted that the evaporating temperature can be approximated as being either 45 degrees F., 50 degrees F., or 55 degrees F. without materially affecting the condensing temperature calculation. Therefore, 45 degrees F. is typically chosen by the control module 22 when making the above calculation.

Figure 8:
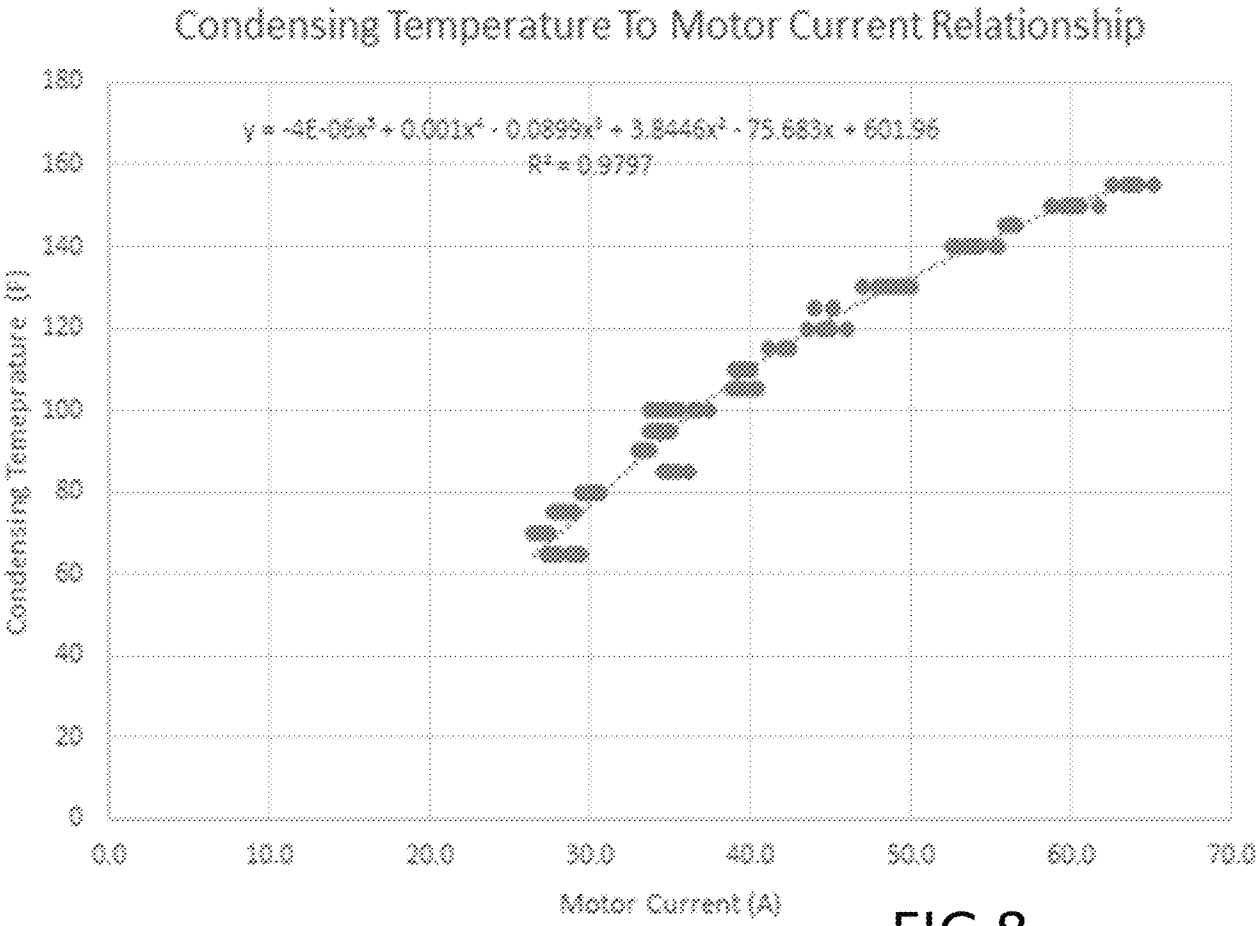
FIG. 8 is a graph of condensing temperature versus motor current.

As an alternative to the above methods for determining condensing temperature, the condensing temperature may be calculated using only motor current data (e.g., from the first sensor 36). That is, the condensing temperature may be calculated from a polynomial equation based on a regression of current (amperage) versus condensing temperature data (e.g., data published by a compressor manufacturer), where the motor current correlates closely to condensing pressure (and therefore, condensing temperature), as shown in FIG. 8. The following equation is an example of such a polynomial equation for an exemplary compressor, where A is compressor-motor current, $C_0$-$C_5$ are compressor-specific constants (e.g., constants that are specific to a particular model and size compressor and obtained through testing for a particular compressor), and $T_{cond}$ is condensing temperature:

$$T_{cond}=-0.0006\,A^5+0.001\,A^4-0.0899\,A^3+3.8446\,A^2-75.683\,A+601.96$$

The above equation is applicable to all compressors (with constants $C_0$-$C_5$ being chosen for a specific compressor) and can be simplified as necessary by reducing the equation to a lesser-order polynomial with minimal comprise on accuracy. Multiple equations can be generated as necessary to account for additional variables (such as voltage or operating speed) on the behavior of condensing pressure on current. Because the principles of the present disclosure can be used with multi-speed compressors and applied in multiple grid voltage situations, the above equation may be corrected based on a motor speed (e.g., obtained from current signal) and a measured voltage, for example.

While step 110 of the floodback-detection algorithm 100 is described above as determining a non-measured condensing temperature, in some configurations of the algorithm 100, the control module 22 may, at step 110, obtain a measured condensing temperature value from a temperature sensor that measures condensing temperature directly. In such configurations, the first sensor 36 may be a temperature sensor disposed on or in a coil of the outdoor heat exchanger 14, for example. The first sensor 36 may measure the condensing temperature and communicate the measured condensing temperature value to the control module 22 via a wired or wireless connection between the first sensor 36 and the control module 22. Alternatively, the first sensor 36 may be a pressure sensor measuring the pressure of working fluid at a high-pressure side of the system 10 (e.g., at a location at or near the outdoor heat exchanger 14 or along the discharge line 42, for example. The control module 22 may receive this pressure data from the first sensor 36 and convert the measured pressure value to a condensing temperature value (i.e., since the pressure of the working fluid at a location within the system 10 is proportional to the temperature of the working fluid at the same location).

Figure 4:
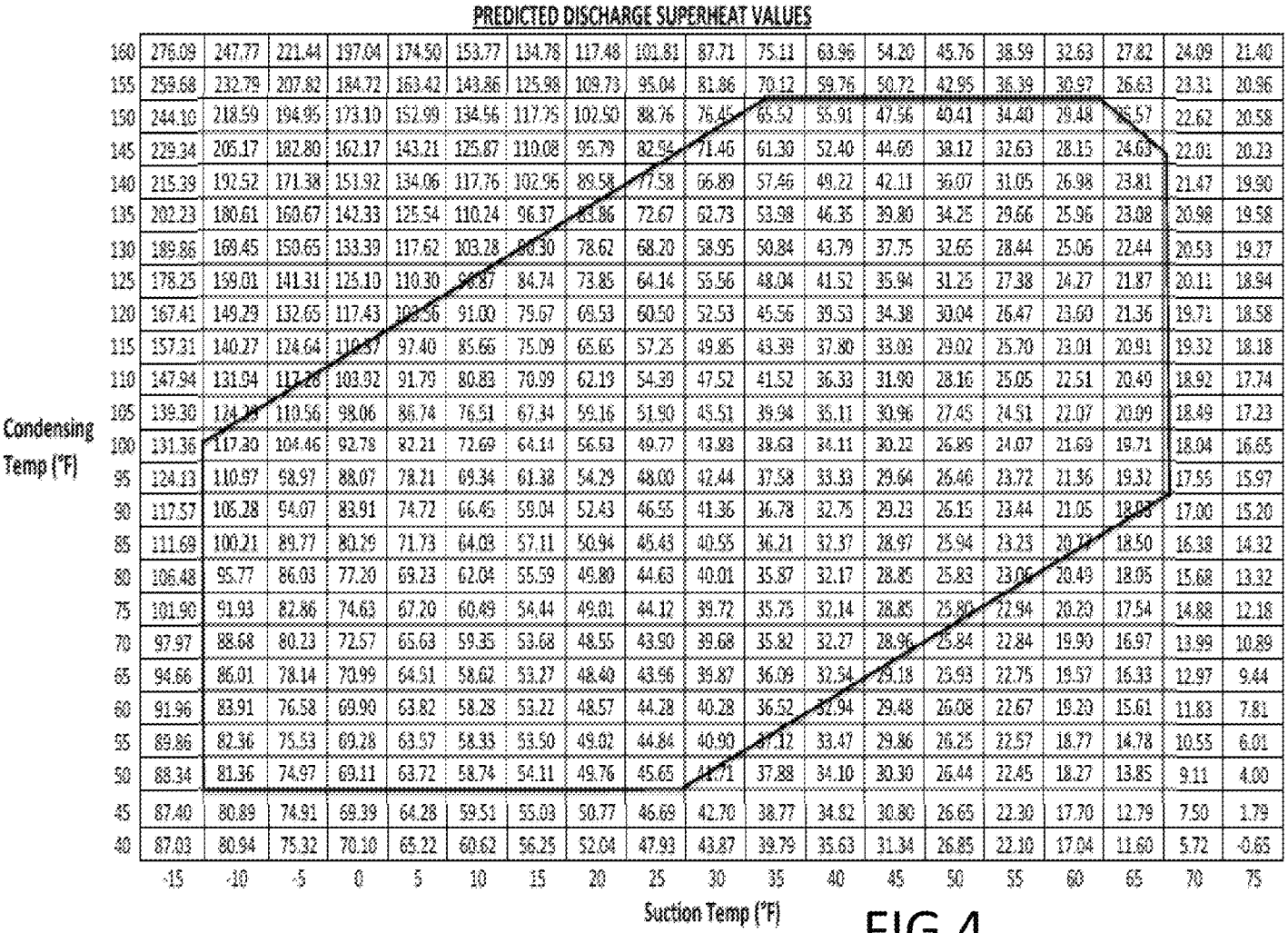
FIG. 4 is a table of predicted discharge superheat values.

Referring again to FIG. 2, once the condensing temperature has been determined, the control module 22 may determine a theoretical discharge-superheat-value ($DSH_{theor}$) at step 120 and an actual discharge-superheat-value theor, ($DSH_{actual}$) at step 130. To determine the theoretical discharge-superheat-value, the control module 22 may reference a lookup table or map, such as the table shown in FIG. 4. The lookup table shown in FIG. 4 includes theoretical discharge-superheat-values corresponding to a particular set of condensing temperature and suction temperature values. The control module 22 may use the condensing temperature value determined at step 110 and a suction temperature value measured by the third sensor 40 to lookup the theoretical discharge-superheat-value that corresponds to those values in the lookup table.

The control module 22 may calculate the actual discharge-superheat-value (step 130) by subtracting the condensing temperature (determined at step 110) from the temperature measurement taken by the second sensor 38

(i.e., discharge temperature; hereinafter, $T_{dis}$). Stated in the form of an equation, $DSH_{actual}=T_{dis}-T_{cond}$.

After steps 120 and 130 are complete, the control module 22 may, at step 140, compare the actual discharge-superheat-value (calculated at step 130) with the theoretical discharge-superheat-value (determined at step 120). If the actual discharge-superheat-value is greater than or equal to the theoretical discharge-superheat-value, then the control module 22 determines that a floodback condition does not exist and the working fluid in the discharge line 42 is superheated (step 150). If the actual discharge-superheat-value is less than the theoretical discharge-superheat-value, then the control module 22 determines that a floodback condition does exist (step 160).

Figure 5:
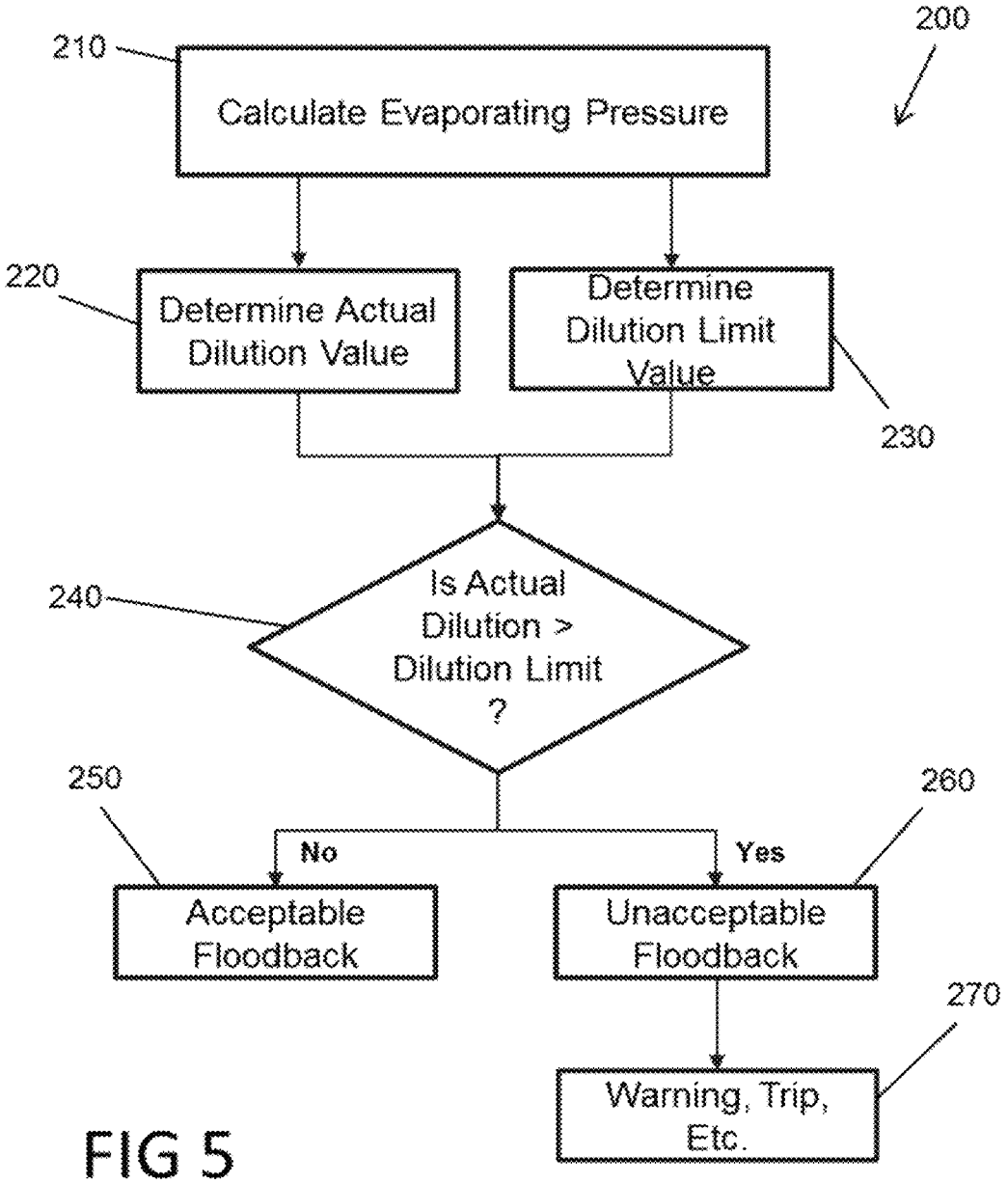
FIG. 5 is a flowchart depicting an algorithm for determining a severity of the floodback condition.

If the control module 22 determines that a floodback condition exists, the control module 22 may execute a floodback protection algorithm 200 (FIG. 5) to determine whether the floodback condition is at an acceptable (beneficial) level or an unacceptable (severe) level based on oil dilution values. At step 210, the control module 22 may calculate evaporating pressure. During a floodback condition, the evaporating temperature can be assumed to be equal to the temperature measured by the third sensor 40 (suction temperature). Therefore, the evaporating pressure for a given working fluid can be calculated as a function of suction temperature (as evaporating temperature is proportional to suction temperature). In some configurations, the control module 22 may read a measured evaporating pressure value (e.g., measured by a temperature sensor or a pressure sensor) at step 210.

At step 220, the control module 22 may calculate an actual oil dilution value using the following equation:

$$\log_{10}(P) = a_1 + \frac{a_2}{T} + \frac{a_3}{T^2} + \log_{10}(\omega)\left(a_4 + \frac{a_5}{T} + \frac{a_6}{T^2}\right) + \log_{10}^2(\omega)\left(a_7 + \frac{a_8}{T} + \frac{a_9}{T^2}\right),$$

where P is a pressure of gaseous working fluid immediately above an oil level in the oil sump 34 within the compressor 12, ω is the actual oil dilution value, T is a temperature of the oil in the oil sump 34 (measured by the fourth sensor 41), and $a_1$ through $a_9$ are constants. In a low-side compressor, the pressure P of the gaseous working fluid immediately above the oil level in the oil sump 34 can be assumed to be equal to evaporating pressure (calculated or measured at step 210). The constants $a_1$ through $a_9$ are dilution coefficients that are provided by working fluid (e.g., refrigerant) manufacturers for a combination of a given working fluid and a given oil. Exemplary dilution coefficients provided by DuPont™ for a combination of Suva® R410A refrigerant and POE (polyolester) synthetic oil are shown in FIG. 6.

Figure 7:
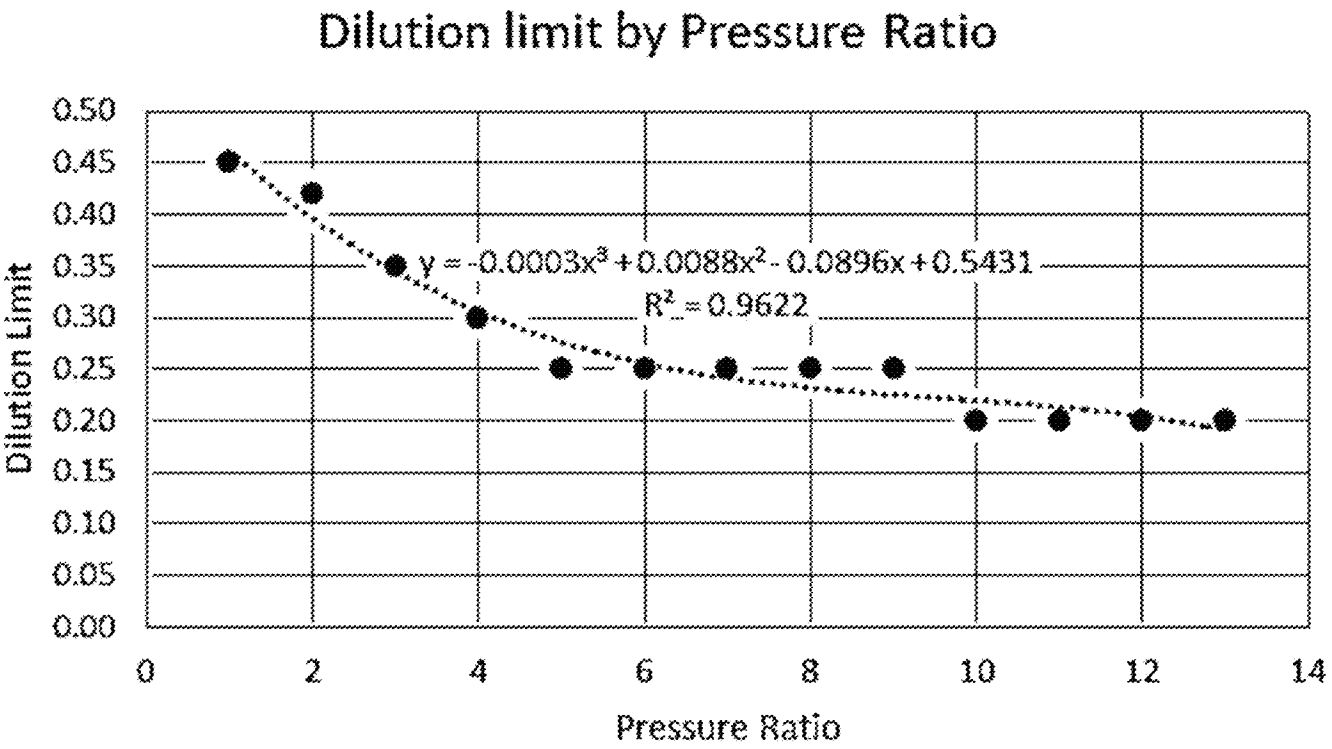
FIG. 7 is a graph of dilution limit versus pressure ratio.

At step 230, the control module 22 may determine a dilution limit value based on a pressure ratio (condensing pressure to evaporating pressure) of the system 10. Because a one-to-one correlation exists between condensing pressure and condensing temperature and between evaporating pressure and evaporating temperature, the pressure ratio ($P_{ratio}$) of the system 10 can be calculated by the equation $P_{ratio}=T_{cond}/T_{evap}$. As described above, the condensing temperature is calculated at step 110 of the floodback detection algorithm 100, and evaporating temperature can be assumed to be equal to the suction temperature measured by the third sensor 40. Once the pressure ratio is determined, the control module 22 can determine the dilution limit value by a lookup table or from the graph and equation shown in FIG. 7, where y is the dilution limit value, and x is the pressure ratio.

At step 240, the control module 22 may compare the actual dilution value (determined at step 220) and the dilution limit value (determined at step 230). If the actual dilution value is less than or equal to the dilution limit value, the control module 22 may determine that the floodback is at an acceptable level (step 250). If the actual dilution value is greater than the dilution limit value, the control module 22 may determine that the floodback is at an unacceptable level (step 260). If the floodback is at an unacceptable level, the control module 22 may, at step 270, issue a fault warning or notification, change a rotational speed of the motor 28 of the compressor 12, trip a motor protector temporarily disabling the compressor 12, and/or control the expansion device 16, the compressor motor 28, pumps (not shown), and/or blowers 15, 19, for example, to reduce or eliminate the floodback.

While the algorithm 200 is described above as determining whether the floodback condition is at an acceptable level or an unacceptable level based on oil dilution values, in some configurations, the algorithm 200 may determine the severity of the floodback condition based on oil viscosity values.

In this application, including the definitions below, the term "module" may be replaced with the term "circuit" or "processing circuitry." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising:

a compressor having a shell, a compression mechanism disposed within the shell, and a motor driving the compression mechanism;

a first heat exchanger receiving compressed working fluid from the compressor;

a second heat exchanger in fluid communication with the compressor and the first heat exchanger;

a first sensor detecting a parameter indicative of a temperature of working fluid within the first heat exchanger;

a second sensor detecting a discharge temperature of fluid discharged from the compressor;

a third sensor detecting a suction temperature of fluid upstream of the compression mechanism and downstream of the first and second heat exchangers;

a fourth sensor detecting an oil temperature of oil in a sump defined by the shell; and processing circuitry in communication with the first, second, third and fourth sensors and determining whether a refrigerant floodback condition is occurring and a severity of the refrigerant floodback condition based on data received from the first, second, third and fourth sensors.

2. The system of claim 1, wherein the first sensor is a current sensor that measures a current of the motor.

3. The system of claim 1, wherein the first sensor is a pressure sensor measuring a pressure of working fluid at a location along a high-pressure side of the system.

4. The system of claim 1, wherein the only measured data used to detect the refrigerant floodback condition is data measured by the first, second and third sensors.

5. The system of claim 4, wherein the processing circuitry determines whether a refrigerant floodback condition has occurred based on a comparison between a calculated discharge-superheat-value and a predetermined discharge-superheat-threshold.

6. The system of claim 5, wherein the severity of the refrigerant floodback condition is determined based on a level of oil dilution in an oil sump disposed within the shell of the compressor.

7. The system of claim 6, wherein the level of oil dilution is calculated using the equation:

$$\log_{10}(P) = a_1 + \frac{a_2}{T} + \frac{a_3}{T^2} + \log_{10}(\omega)\left(a_4 + \frac{a_5}{T} + \frac{a_6}{T^2}\right) + \log_{10}^2(\omega)\left(a_7 + \frac{a_8}{T} + \frac{a_9}{T^2}\right),$$

wherein P is a pressure of gas immediately above an oil level in the oil sump within the compressor; wherein ω is the level of oil dilution; wherein T is a temperature of the oil in the oil sump; and wherein $a_1$ through $a_9$ are constants.

8. The system of claim 7, wherein the severity of the refrigerant floodback condition is determined based on a comparison of the level of oil dilution and a dilution limit value.

9. The system of claim 8, wherein the dilution limit value is determined based on a calculated condensing temperature and a calculated evaporating temperature.

10. The system of claim 9, wherein the pressure (P) of gas immediately above the oil level is determined based on the suction temperature measured by the third sensor.

11. The system of claim 10, wherein the processing circuitry issues a fault warning or a fault trip in response to determining the severity of the refrigerant floodback condition.

12. The system of claim 11, wherein the compressor is a low-side scroll compressor.

* * * * *